United States Patent [19]

Shafer

[11] Patent Number: 4,646,374

[45] Date of Patent: Mar. 3, 1987

[54] ORTHOTIC SLING SEAT CUSHION

[75] Inventor: Alice Shafer, Wayland, Mass.

[73] Assignee: Alimed, Inc., Dedham, Mass.

[21] Appl. No.: 689,456

[22] Filed: Jan. 7, 1985

[51] Int. Cl.[4] ..... A47C 27/14; A47C 20/02

[52] U.S. Cl. ..... 5/481; 5/431; 297/DIG. 4; 128/69

[58] Field of Search ..... 5/90, 446, 431, 436, 5/434, 484, 490, 481; 297/458, 459, DIG. 1, DIG. 4

[56] References Cited

U.S. PATENT DOCUMENTS

| | | | |
|---|---|---|---|
| 1,742,108 | 12/1929 | Taylor | 5/446 |
| 2,314,080 | 3/1943 | Dine et al. | 5/431 |
| 3,389,411 | 6/1968 | Emery | 5/490 |
| 3,644,949 | 2/1972 | Diamond | 5/436 |
| 3,924,283 | 12/1975 | Shave | 5/434 |
| 4,278,719 | 7/1981 | Sarnecki | 5/484 |
| 4,472,848 | 9/1984 | Newman | 5/463 |

FOREIGN PATENT DOCUMENTS 2012159 7/1979 United Kingdom .

*Primary Examiner*—Gary L. Smith
*Assistant Examiner*—Michael F. Trettel
*Attorney, Agent, or Firm*—Wolf, Greenfield & Sacks

[57] ABSTRACT

A seating orthotic cushion comprised of an elongated wedge of resiliently deformable material having a substantially planar top surface, a front surface meeting the top surface, and a bottom surface comprising a plurality of planar portions extending side-by-side from the front of the cushion to the back, the portions meeting in such a way that the bottom of the cushion slopes progressively upward toward the top of the cushion on either side of a line substantially bisecting the cushion between its sides. This seating orthotic cushion preferably includes a waterproof cover having a high coefficient of friction, and filled with an organic foam material.

12 Claims, 5 Drawing Figures

ORTHOTIC SLING SEAT CUSHION

This invention relates to a seating orthotic in the form of a cushion, and particularly to a seat cushion for use in connection with a sling-seat folding wheelchair.

BACKGROUND OF THE INVENTION

Folding wheelchairs commonly include a seat comprising a length of canvas or other material attached to parallel horizontal bars at the sides of the chair to form a generally parabola-shaped sling. However, when a person sits in a wheelchair with a sling-shaped seat, an unfavorable relationship between the hip and the spine develops. The pelvis shifts into a posterior pelvic tilt, which results in discomfort, lower back pressure and a strong tendency to slide forward. Seat belts are often used to prevent falling. It is preferred to have the pelvis rotated from the posterior tilt so that the hips are flexed and slightly bent in a position known as "anterior pelvic tilt." Attainment of such an effect is sometimes attempted by placing a board across the chair from one side horizontal bar to another. Others have simply placed a bulky bottom pad on the sling seat or used a wedge pad, sometimes in combination with a board. These solutions are less than wholly satisfactory.

SUMMARY OF THE INVENTION

The primary objective of this invention is to provide an orthopedic seating orthotic in the form of a cushion to be used in a sling-seat type of wheelchair as a means of compensating for the unfavorable postural changes which frequently occur when a person sits in the unmodified seat.

It is a further object of this invention to provide such a cushion that is compact and attractive, yet affords the desired anterior pelvic tilt with regard to the seated person.

It is another object of this invention to provide such a cushion that is lightweight, readily cleanable, nonslippery, yet comfortable and durable.

It is still another object of this invention to provide such a cushion that may be effectively utilized on any sling-seat chair, regardless of the curvature of the particular parabolic shape formed by the sling-seat.

According to the invention an orthopedic sling-seat cushion has a resiliently deformable body with a top body support surface defining side, front and back edges, and lying substantially in a plane sized to extend from front to back and side to side of a sling-seat upon which the cushion is designed to be used. A non-planar bottom surface is spaced from the top body support surface and defines a first side-to-side configuration shaped to mate with or to approximate the parabolic curve of a sling-seat and extending upwardly towards the top surface side edges. The bottom surface further defines a front to back wedge shape in said cushion with a front edge of said bottom surface being spaced further from the front edge of the top body support surface than the back edge of the bottom surface is spaced from the back edge of the top surface. Thus, the orthopedic sling-seat cushion provides a plural effect to the body seated thereon in a sling-seat, with the hips flexed and slightly bent and maintained perpendicular to the long axis of the body in a side to side direction and with the leg bone adjacent the hip at an acute angle to said long axis in a front to back direction preferably at an angle of about 70°.

Preferably, the cushion has a non-self-supporting cover of a rubberized cloth or other waterproof material having a high co-efficient of friction to aid in preventing slippage of the cushion in use.

It is a feature of this invention that the cushion encourages an anatomically preferred sitting posture in standard, sling-seat wheelchairs. The cushion enables the individual to be comfortably positioned in an anterior pelvic tilt which results in less slouching and sliding. Because the bottom surface is formed of a plurality of planes, which meet at line edges substantially transverse to the curve of the sling-seat, these line edges can provide a further means of preventing side to side sliding of the cushion. It is believed that they tend to compress more and offer more resistance to side to side sliding than would a generally rounded curved surface.

It is an important feature of this invention that positive bi-directional placement of the hips of a body seated on a cushion is provided. The hips are considered to have two axes for purposes of this invention, with one axis running through the hips from side to side thereof, parallel to the ground and perpendicular to the long axis vertically drawn through the vertebra of the body, and a second axis perpendicular to the vertebra in a front to back direction at the level of the hips and parallel to the ground when the body is in a normal standing position on level ground. The axis perpendicular to the vertebra in a side to side direction is maintained in that position when the body is seated on the cushion of this invention while the axis perpendicular to the vertebra, or long axis of the body in a front to back direction, is bent at an acute angle with respect to the long axis of the body when the body is seated on the orthopedic cushion of this invention mounted on a conventional sling-seat.

BRIEF DESCRIPTION OF THE DRAWINGS

The subject invention will be more readily understood and appreciated with reference to the accompanying drawings, in which.

DETAILED DESCRIPTION OF THE INVENTION

Figure 1:
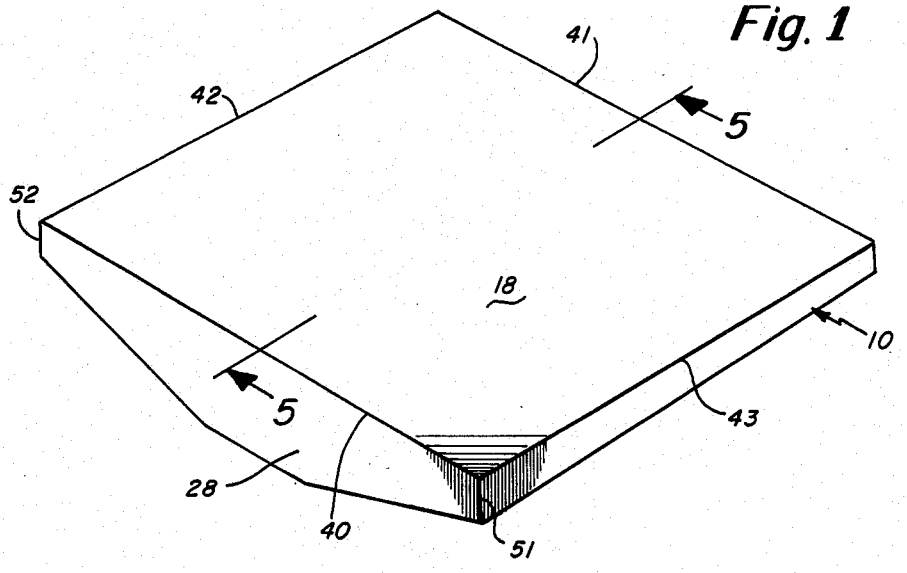
FIG. 1 is a perspective view of a cushion constructed in accordance with a preferred embodiment of the subject invention.
Figure 2:
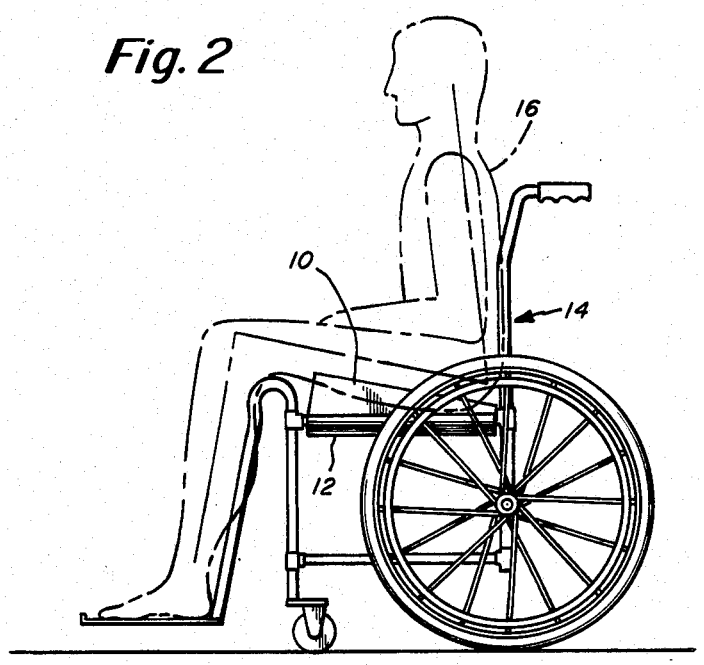
FIG. 2 is an illustrative drawing of the cushion of FIG. 1 in position on the seat of a sling-seat wheelchair.

Referring to FIGS. 1 and 2, there is depicted an orthopedic sling-seat cushion 10 having generally a front to back wedge shape, the large end of the wedge being positioned at the front of the sling-seat 12 of wheelchair 14. Shown in phantom lines is a person 16 seated in sling-seat wheelchair 14, and benefitting from the anterior pelvic tilt effected by the cushion 10 constructed according to the subject invention.

The orthopedic sling-seat cushion provides a plural synergistic effect to the body seated on the cushion in the wheel chair 14. The hips are positioned in approximately 110° of flexion, which results in the desired anterior pelvic tilt and is maintained in this position because the top cushion surface is maintained perpendicular to the long axis of the body in a side to side direction and at an acute angle thereto in a front to back direction. The positioning of the hips is brought about by the modified wedge shape of the cushion with the larger edge of the wedge intended to be placed along the front edge of the wheel chair seat. The bottom surface of the cushion preferably being tri-planar, the two outermost planar portions each slope slightly upwardly from the middle planar portion, giving the desired front to back tilt and also providing front to back extending lower edges which may aid in applying pressure at line points transverse to the curve of the sling-seat surface and thereby preventing undesired displacement of the cushion.

Figure 3:
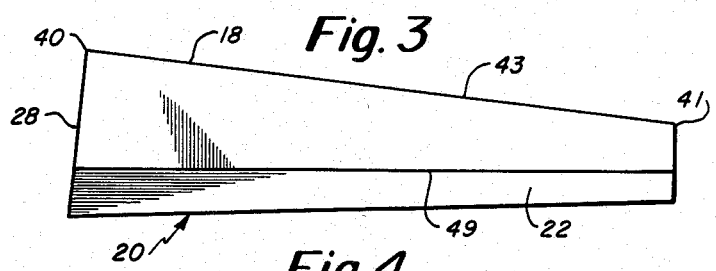
FIG. 3 is a side view of the cushion of FIG. 2, as seen from the side of the wheelchair.
Figure 4:
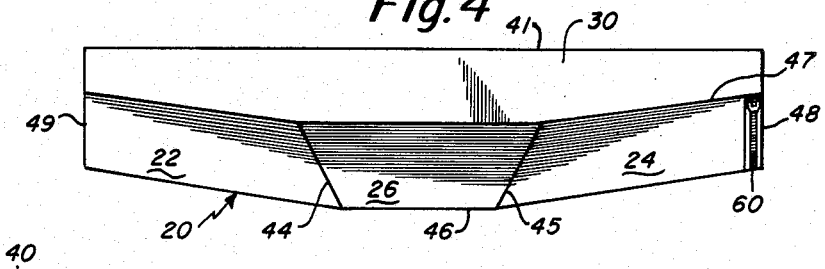
FIG. 4 is a view of the cushion of FIG. 2 as seen from the rear of the wheechair.
Figure 5:
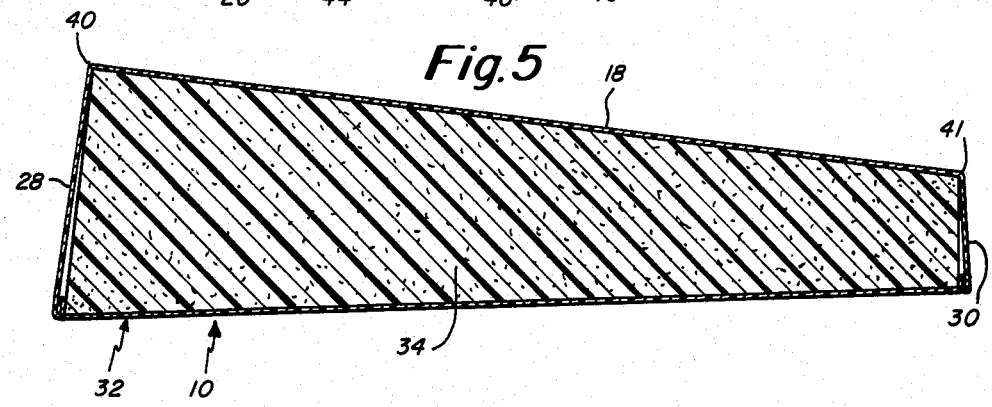
FIG. 5 is a cross-sectional view of the cushion of FIG. 1, taken along the line 5—5 of FIG. 1.

The construction of cushion 10 is best appreciated by reference to FIGS. 3, 4 and 5. Top surface 18 of cushion 10 is essentially planar, and, for example, may be approximately 16 inches by 18 inches in size. The top surface defines front top edge 40, back edge 41, and side edges 42 and 43 with the front and back edges and the side edges being respectively parallel to form a rectangle. In the preferred embodiment here described, the bottom surface 20 of cushion 10 is comprised of three planar sections each extending from the front to the back of cushion 10. The bottom surface defines front edge 46, back edge 47 and side edges 48 and 49 generally underlying corresponding front, rear and side edges of the top surface in the preferred embodiment. Side sections 22 and 24 slope slightly upwardly from middle section 26 in such a way as to form a very flattened generally U-shape, middle section 26 comprising the base of the U, while side sections 22 and 24 form the legs of the U. Thus tri-planar construction enables the cushion to conform generally to the sling-shape of the seat regardless of the particular curvature and dimensions of the parabola formed by the sling-seat. Lines 44 and 45 extend generally transverse to the side supports of the sling-seat 12 and further are believed to act to prevent side to side sliding of the cushion in the sling-seat. It will be readily appreciated that the bottom of the cushion could be formed by a plurality of generally planar sections comprising two, three, four or more planar sections. However, the tri-planar construction here described is preferred because it conforms satisfactorily to a wide-range of sling-shaped seats, and yet is simple and economical to manufacture.

In the particular embodiment here described, front surface or panel 28 of cushion 10 is generally in the form of a six-sided polygon approximately four inches high at the center of the cushion between top edge 40 and bottom edge 46, while the back of the cushion at 30 is approximately one and one-half inches in height at its center. Front side wall corner edges 51 and 52 have a height of 3 inches and rear side wall corner edges 48 and 49 have a height of ½ inch. The angle formed between the plane of top surface 18 and middle section 26 of bottom 20 is preferably in the range of 15 degrees to 20 degrees. As seen in FIG. 2, when cushion 10 is in place on the sling-seat, the front edge 40 of top surface 18 is parallel to the ground, as is middle section 26, while top surface 18 slopes downward toward the back of the wheelchair and back edge 41 to provide the tilt to the hips while maintaining them parallel to the ground, from side to side, assuming the chair and sling-seat are both level.

Referring to FIG. 5, cushion 10 is preferably comprised of a cover 32 which contains deformable non-self-supporting material 34 cut or formed in the desired modified wedge-shape. Cover 32 is preferably comprised of a material having a high co-efficient of friction in order to minimize the risk that the person sitting in the chair will slide or slip off the cushion. Furthermore such a material will ensure that the cushion itself will stay in place on the wheelchair seat. To further ensure a high degree of friction between the cushion and the seat, and between the cushion and the seated person, the cover may be provided with a mottled or otherwise non-smooth surface. As an additional consideration, it is preferred that the cover material be waterproof. A suitable material for the cover is a rubberized cloth such as Naugahyde, a trademarked product of Uniroyal; sheepskin; cotton or synthetic textile; and other cover materials could be used including non-waterproof materials. In a preferred embodiment the cover is a Spec. S/1467 Grey Sleeper feet vinyl cotton fabric obtained from Prevel Industries, Inc. of Plainfield, Conn.

Cover 32 is preferably filled with a deformable material 40, and preferably an expanded material such as a resilient organic foam material such as foam rubber, natural or synthetic, including polyurethanes, polyesters, polyvinyl chlorides and the like, which will enable cushion 10 to keep its wedge-shape when no one is seated on it, but which will be readily deformable and act to cushion the body when sat upon while still providing the angular arrangement to the body when compressed. Preferably the organic foam has an ILD of at least 50. In a preferred embodiment Style 9010 polyester foam (4 lbs/cubic foot) charcoal grey spec 2 of UL-94HF1 is used, obtained from Crest Foam Corp. of Moonachie, N.J.

Preferably a zipper such as 60 (FIG. 4) or other fastening means is used to secure the cover 32 on the cushion. The cover 32 is preferably an enclosing shape corresponding to the shape of the cushion or stretchable thereover to conform to the shape of the cushion body 34. Depending upon the material used, the cover can be formed in various ways. Normally lines of sewing are used at edges where necessary to sew the material together into a bag shape to act as the cover.

It will be readily appreciated that the foregoing description of the invention is intended merely to be illustrative thereof, and that other modifications and embodiments may be apparent to those skilled in the art without departing from its spirit.

For example, while the upstanding corner edges of the cushion can be at right angles, as is the joinder of the front surface with the top surface, other angles could be used or rounded edges are possible. Similarly, although a rectangular upper surface in plan view is shown, the pillow could have other shapes that vary depending upon the particular usage. In all cases, the bottom surface of the cushion is designed to meet with a sling-seat with which it is used to conform to ordinary parabolic curves of sling-seats so as to be useful in the invention. The particular stiffness and resiliency of the cushion can vary greatly in line with providing overall user comfort while still providing the support and anterior pelvic tilt desirable.

What I claim is:

1. An orthotic sling seat cushion comprising an elongated wedge of deformable material having a substantially planar top surface, a front surface meeting the top surface and a bottom surface comprising a plurality of portions extending side-by-side from the front of the cushion to the back forming an overall front to back wedge shape to provide desired pelvic tilt when used on a sling wheelchair type seat, the portions meeting in such a way that the bottom of the cushion slopes substantially progressively upward toward the top of the cushion on either side of a line substantially bisecting the cushion between its sides.

2. The cushion of claim 1 herein said bottom surface comprises a middle planar portion and two side portions, the side portions sloping gradually upward from the plane of the middle portion toward the top of the cushion.

3. The cushion of claim 1, wherein said material is an organic foam having an ILD value exceeding 50.

4. The cushion of claim 3, further comprising a cover closely conforming to the wedge of material.

5. The cushion of claim 4, wherein said cover comprises a material having a high coefficient of friction.

6. The cushion of claim 5, wherein said cover comprises a substantialy waterproof material.

7. The cushion of claim 6, wherein said cover comprises a cloth backed vinyl coated fabric.

8. An orthotic sling seat cushion comprising a waterproof cover having a high coefficient of friction, filled with a deformable material, and formed in a modified wedge shape having a substantially planar top surface meeting the wide end of the wedge at substantially an angle, a tri-planar bottom surface forming the long side of the wedge, the three planar portions of the bottom each extending from the front of the cushion to the back, one such portion being located in the middle of the cushion, with the other two sloping slightly upward on opposite sides of the middle portion.

9. The cushion of claim 8, wherein said deformable material comprises an organic foam.

10. A method of providing anterior pelvic tilt to a body in a wheel chair sling-seat, said method comprising positioning a cushion on said sling-seat, said sling-seat cushion comprising an elongated wedge of deformable material having a substantially planar top surface, a front surface meeting the top surface at an angle, and a bottom surface comprising a plurality of planar portions extending side-by-side from the front of the cushion to the back, the portions meeting in such a way that the bottom of the cushion slopes progressively upward toward the top of the cushion on either side of a line substantially bisecting the cushion between its sides, and positioning the body on said cushion on said seat in a sitting position with the pelvis in the desired position.

11. An orthopedic sling-seat cushion comprising:

a resiliently deformable body having a top body support surface defining side edges and front and back edges and lying substantially in a plane sized to extend from front to back and side-to-side of a sling-seat with which the cushion is designed to be used, a non-planar bottom surface spaced from said top body support surface, said bottom surface defining a first side-to-side configuration shaped to mate with a parabolic curve of a sling-seat and extending upwardly towards said top surface side edges, said bottom surface further defining a front to back wedge shape in said cushion with a front edge of said bottom surface being spaced further from said front edge of said top body support surface than a back edge of said bottom surface is spaced from said back edge of said top surface, whereby said orthopedic sling-seat cushion provides a plural effect to the body seated thereon in a sling-seat, with the hips flexed and slightly bent and maintained perpendicular to the long axis of the body in a side-to-side direction and having a front to back axis through the hips at an acute angle thereto in a front to back direction.

12. The cushion of claim 11 wherein said bottom surface comprises a plurality of planar portions extending side by side from the front of the cushion to the back, the portions meeting in such a way that the bottom of the cushion slopes progressively upward toward the top of the cushion on either side of a line substantially bisecting the cushion between its sides.

* * * * *